United States Patent [19]

Grieger et al.

[11] 3,969,985

[45] July 20, 1976

[54] FLUID ACTUATING DEVICE FOR AN ELECTRIC CIRCUIT BREAKER

[75] Inventors: Gerhard Grieger; Joaquin Bohrdt, both of Berlin, Germany

[73] Assignee: Siemens Aktiengesellschaft, Munich, Germany

[22] Filed: July 2, 1973

[21] Appl. No.: 375,746

[30] Foreign Application Priority Data

July 12, 1972 Germany ..... 2235074

[52] U.S. Cl. ..... 91/416; 91/417 R; 91/459; 91/461; 137/625.64; 137/625.66; 200/82 B

[51] Int. Cl.[2] ..... F15B 13/043; F15B 15/17; H01H 35/38

[58] Field of Search ..... 91/416, 417, 461, 304, 91/459, 275, 361; 200/82 B; 137/625.63, 625.66, 625.64

[56] References Cited

UNITED STATES PATENTS

| | | | |
|---|---|---|---|
| 2,617,444 | 11/1952 | Gardner | 137/625.64 |
| 2,900,960 | 8/1959 | Gratzmuller | 91/417 X |
| 3,008,017 | 11/1961 | Strom et al. | 200/82 B |
| 3,105,126 | 9/1963 | Peek et al. | 91/417 X |
| 3,131,722 | 5/1964 | Abbott et al. | 137/625.66 X |
| 3,208,720 | 9/1965 | Huntington | 137/625.66 X |
| 3,229,958 | 1/1966 | Borel | 91/417 X |
| 3,832,502 | 8/1974 | Grieger et al. | 200/82 B |

*Primary Examiner*—Irwin C. Cohen
*Attorney, Agent, or Firm*—Kenyon & Kenyon Reilly Carr & Chapin

[57] ABSTRACT

A fluid actuating device for an electric switching apparatus such as a high-voltage power circuit breaker or the like includes an actuator for actuating the switching apparatus. The actuator in turn is made up of a cylinder and an actuator differential piston movable in the cylinder between positions corresponding to the open and closed positions of the switching apparatus. A fluid supply provides fluid under high-pressure to the end-faces of the actuator differential piston. A main-valve arrangement includes a main-valve differential piston movable for alternately interrupting and connecting fluid from the fluid supply to one of the end-faces of the actuator differential piston whereby the actuator differential piston is caused to move between its end positions. The main-valve differential piston also has end-faces fluidly connected to the fluid supply. A control valve arrangement includes a control differential piston which interrupts and connects the fluid supplied to one of the end-faces of the main-valve differential piston thereby actuating the same. A control arrangement actuates the control differential piston in response to inputs for opening and closing the switching apparatus. The main-valve differential piston and the control differential piston are actuable exclusively by the pressure of the fluid from the fluid supply and this enables the two last-mentioned pistons to maintain their end positions independent of the instantaneous value of the pressure of the fluid.

18 Claims, 2 Drawing Figures

FLUID ACTUATING DEVICE FOR AN ELECTRIC CIRCUIT BREAKER

BACKGROUND OF THE INVENTION

The invention relates to a fluid actuating device for an electric switching apparatus such as a circuit breaker, particularly, a high-voltage power circuit breaker. The device of the invention includes an actuator arrangement which includes a differential piston and a cylinder. The actuator arrangement can be acted upon by pressure fluid through a main-valve arrangement with a control valve arrangement controlling the main-valve arrangement.

In a hydraulic actuating device of this kind the problem occurs of transmitting the closing and opening commands to the movable contacts of the electric circuit breaker with the least possible delay.

Accordingly, it is an object of the invention to prevent a creeping switching motion of the circuit breaker. Such a creeping switching motion can occur if the pressure of the pressure fluid drops so far that spring-loaded main-valves of the known arrangements are brought by their spring force into a position which leads to a reversal of the drive, so that, when the hydraulic pump starts up, the pumping rate directly determines the reversal speed of the movable contacts. Accordingly, and subsidiary to the foregoing object, it is another object of the invention to provide a fluid actuating device wherein the need for such spring-loaded main-valves is unnecessary.

BRIEF SUMMARY OF THE INVENTION

According to the invention, the main-valve arrangement and the control valve arrangement each comprise a piston that can be acted upon by pressure fluid, and which is, like the drive piston configured as a differential piston and can be moved into two preferred positions which are independent of the pressure of the pressure fluid.

The fluid actuating device of the invention is especially suited for an electric switching apparatus such as a high-voltage power circuit breaker or the like. The fluid actuating device includes as a feature an actuator for actuating the electric switching apparatus. The actuator includes a cylinder and an actuator differential piston movable in the cylinder between first and second positions corresponding to the open and closed positions of the switching apparatus. The actuator differential piston has two end-faces for receiving fluid pressure force. High-pressure fluid supply means supplies fluid under high pressure to the end-faces of the actuator differential piston. A main-valve arrangement includes a main-valve differential piston movable between two end positions for alternately interrupting and connecting the fluid from the fluid supply means to one of the end-faces of the actuator differential piston whereby the actuator differential piston is caused to move between the first and second positions. The main-valve differential piston has two end-faces fluidly connected to the fluid supply means. A control valve arrangement includes a control differential piston movable between two end positions for interrupting and connecting the fluid supply from the fluid supply means to one of the end-faces of the main-valve differential piston. The control differential piston likewise has two end-faces also fluidly connected to the fluid supply means. The control valve arrangement includes control means for actuating the control differential piston in response to inputs for opening and closing the switching apparatus by alternately interrupting and connecting the fluid from the fluid supply means to one of the end-faces of the control differential piston.

The main-valve differential piston and the control differential piston are actuable exclusively by the pressure of the fluid of the fluid supply means whereby the two end positions of each of the two last-mentioned pistons are maintained independent of an instantaneous change in the value of the pressure in the fluid.

According to another feature of the invention, the one end-face of each of the differential pistons to which the fluid of the supply means is alternately interrupted and connected is made larger than the other end-face of the same piston.

The invention affords the advantage of preventing a creeping switching motion. In the invention, the valve arrangements have no springs which can cause a change in the valve position if the pressure is reduced. The valves are controlled exclusively by the pressure of the pressure fluid and have two end positions which are maintained independently of the instantaneous pressure of the pressure fluid.

In one preferred embodiment of the hydraulic actuating device according to the invention, the differential piston of the main-valve arrangement is firmly connected with a valve rod rigidly coupling the valves corresponding to the inlet passage and outlet passage of the actuator. The differential piston of the control valve arrangement, too, is preferably firmly connected with a valve rod rigidly coupling the valves corresponding to the inlet and outlet passages of the main-valve arrangement. For self-holding the preferred end position, it is advantageous to provide a bypass for the pressure fluid parallel to the differential piston of the control valve arrangement. Preferably, throttle means is connected serially into the bypass. The differential piston of the control valve arrangement can be controlled, for instance, by spring-loaded valves which can be mechanically and/or electrically operated.

In another embodiment of the invention, the spring-loaded valves for the reversal of the actuator are connected to a common control line which carries pressure fluid and which controls the differential piston of the control valve arrangement. In some cases it is advantageous to connect the one spring-loaded valve through a check valve with this common line which carries the pressure fluid.

The essentially cylindrical differential piston of the main-valve arrangement has preferably two extension members which are arranged on opposite sides of the valve rod and are associated with a cylinder cavity common to both extension members. In this embodiment, the diameter of the seat of the inlet valve for the drive can be smaller than the diameter of the differential piston of the main-valve arrangement.

The extension members are ancillary bodies and prevent a direct connection of the high-pressure side to the low-pressure side during reversal and accordingly reduce the consumption of pressure fluid. The extension members permit large cross-sections of the valve bores without large leakage losses.

The essentially cylindrical differential piston of the control valve arrangement also includes two extension members which are arranged on opposite sides of the valve rod and which are arranged in fitting cylinder bores. The diameter of the seat of the inlet valve for the main-valve arrangement can be chosen smaller here than the diameter of the differential piston of the control valve arrangement. Such a configuration of the control valve arrangement makes it possible in a favorable manner that in the control valve arrangement the geometrical dimensions of the inlet valve for the main-valve arrangement can be made so, relative to the geometrical dimensions of the outlet valve for the main valve arrangement, that the differential piston of the servo control valve arrangement has an unstable position between its two preferred positions, up to the attainment of which a reversal of the main-valve arrangement does not take place, independently of the pressure of the pressure fluid.

The hydraulic actuating device according to the invention affords so-called tip-proof switching, that is, very short ON and OFF signals, whose duration is smaller than the total switching time of the circuit breaker, can be executed without effect on the switching speed, even if the command is interrupted during the switching time, provided the differential piston of the control valve arrangement passes through the unstable position.

Although the invention is illustrated and described herein as a fluid actuating device for an electric circuit breaker, it is nevertheless not intended to be limited to the details shown, since various modifications may be made therein within the scope and the range of the claims. The invention, however, together with additional objects and advantages will be best understood from the following description and in connection with the accompanying drawings.

DESCRIPTION OF THE PREFERRED EMBODIMENTS OF THE INVENTION

Figure 1:
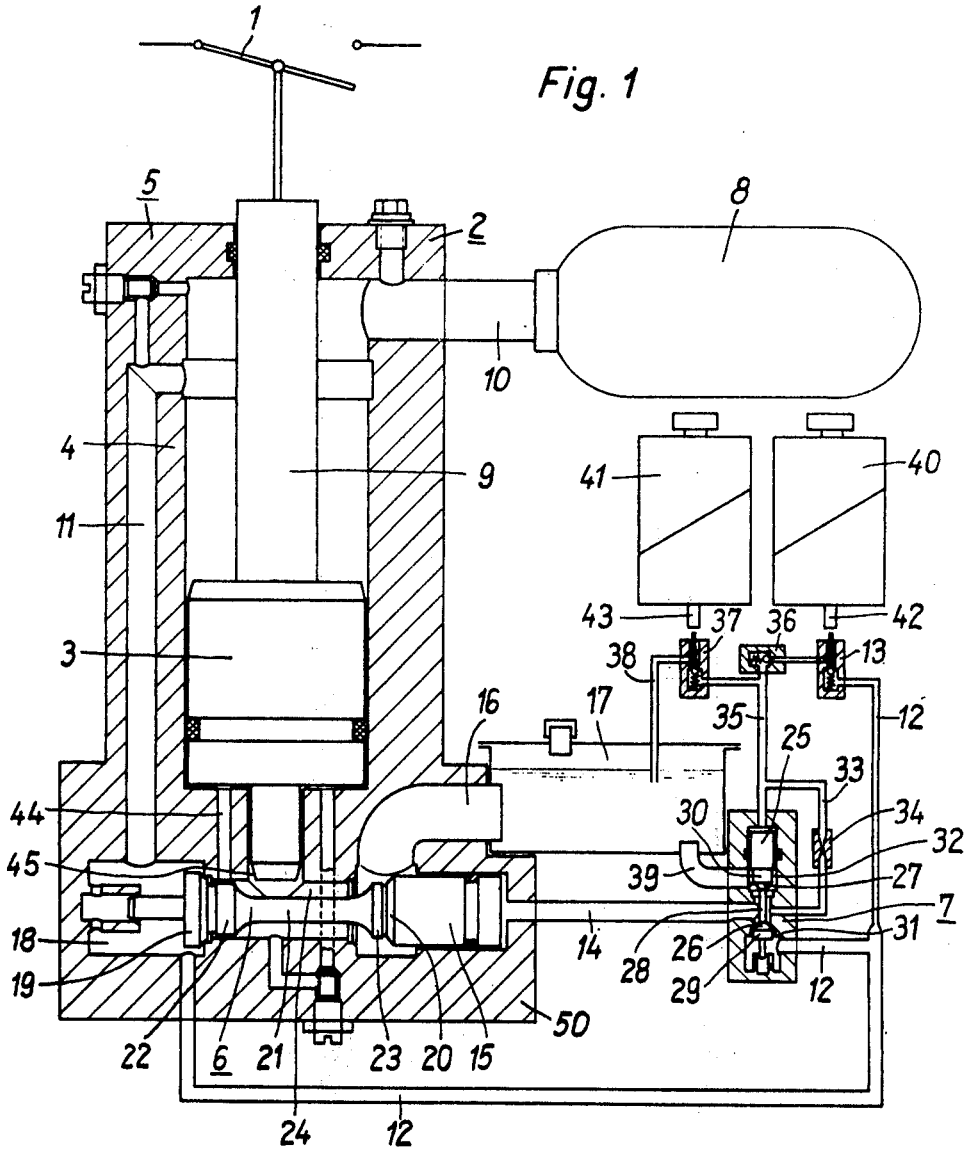
FIG. 1 is a schematic diagram, partially in section, of the fluid actuating device according to the invention. In this embodiment, the actuating device is shown adapted for actuating a circuit breaker. The differential pistons are shown in positions corresponding to the condition wherein the circuit breaker is open.

FIG. 1 shows an electric power circuit breaker 1 which can be configured, for example, as a blast-piston breaker with sulfur hexafluoride as the quenching medium and, at a voltage of 110 kV or more with a switching capacity of 5 GVA. The circuit breaker 1 is operated by a hydraulic actuating device 2. The hydraulic actuating device 2 has an actuator 5 consisting of a differential piston 3 and a cylinder 4. The piston 3 can be acted upon by pressure fluid by means of a main-valve arrangement 6 and a control valve arrangement 7 controlling the arrangement 6. The pressure fluid is taken from a reservoir 8 wherein a predetermined pressure is maintained by means of a pump (not shown).

The differential piston 3 of the actuator 5 is coupled with the movable contact of the breaker 1 via a piston rod 9.

The pressure fluid is supplied from the reservoir 8 to the cylinder 4 of the actuator 5 through a line 10 and feeds a line 11 which leads to the main-valve arrangement 6. The line 11 is connected directly to line 12 for pressure fluid. On the one hand, line 12 leads to the control valve arrangement 7 and, on the other hand, opens into a line to a spring-loaded control valve 13. The control valve 13 is the breaker closing valve.

The main-valve arrangement 6 as well as the control valve arrangement 7 are directional valves (3-way valves).

The main-valve arrangement 6 includes a differential piston 15, which can be acted upon by pressure fluid from the line 14 and which can be moved via the control valve arrangement into two preferred positions, these positions being independent of the pressure of the pressure fluid. In the one preferred position, the large-area side of the differential piston 3 is connected via a line 16 with the low-pressure chamber 17, while in the other position (see FIG. 2), the piston 3 is connected with the high-pressure chamber 18. The chamber 18 is fed from the line 11. For reversing the differential piston 3, the differential piston 15 of the main-valve arrangement 6 is tightly connected with a valve rod 21 which rigidly couples the inlet valve 19 and the outlet valve 20 of the actuator 5. On opposite sides of the valve rod 21 are arranged ancillary bodies 22, 23, which move in a cylinder cavity 24 common to both ancillary bodies 22, 23. The cavity 24 is formed in the body housing 50.

The pressure of the pressure fluid in the line 14 is controlled by the control valve arrangement 7. The control valve arrangement 7 comprises a differential piston 25 which is firmly connected with a valve rod 28 which, in turn, rigidly couples the inlet valve 26 and the outlet valve 27. On opposite ends of the valve rod 28 are arranged ancillary bodies 29 and 30 which engage with adapted cavities 31, 32 respectively.

With the differential piston 25 of the control valve arrangement 7 is associated a bypass 33 into the path of which a throttle point 34 is inserted. The differential piston 25 can be acted upon by pressure via a control line 35 which carries pressure fluid when desired. The spring-loaded valve 13 is connected to line 35 through a check valve 36. Also connected to line 35 is a spring-loaded control valve 37 (OFF valve) whose outlet 38 leads to the low-pressure chamber 17. A line 39 leads from the control valve arrangement 7 to the low-pressure chamber 17. The spring-loaded control valves 13, 37 each are operated by an electromagnetic positioning member 40, 41 in immediate response to a signal which causes the corresponding armature 42 or 43 to be excited.

The function of the hydraulic actuating device described is as follows:

When an ON signal for closing the breaker appears at the electromagnetic positioning member 40, the armature 42 is moved and the spring-loaded control valve 13 is opened. This causes pressure fluid from the line 12 to get through the check valve 36 into the line 35, so that the pressurized pressure fluid moves the differential piston 25 causing the inlet valve 26 to open by means of the valve rod 28. Because of the opening of the inlet valve 26, pressure fluid gets from the line 12 into the line 14. Thus, the valve 26 can be considered as opening a valve inlet passage of the main-valve arrangement when piston 25 is moved as described above. When the differential piston 25 has occupied the position shown in FIG. 2, the full pressure required for reversing the main-valve differential piston 15 can build up in the line 14. In this position, the control differential piston 25 continues to be acted upon by pressure through the bypass 33, so that self-locking in the new position results.

The pressure present in the line 14 reverses the differential piston 15 thereby causing the inlet valve 19 to be lifted off of its seat and pushed into the chamber 18, so that the pressure fluid 11 from the chamber 18 can act on the large-area side of the differential piston 3 via the lines 44, 45. Thus, here the valve 19 can be considered as opening a valve inlet passage of the actuator 5. If the inlet valve 19 is fully opened, the outlet valve 20 is closed because of the rigid coupling afforded by the valve rod 21. The differential piston 3 moves under the prevailing pressure of the pressure fluid into the position shown in FIG. 2 in which the circuit breaker is closed.

Figure 2:
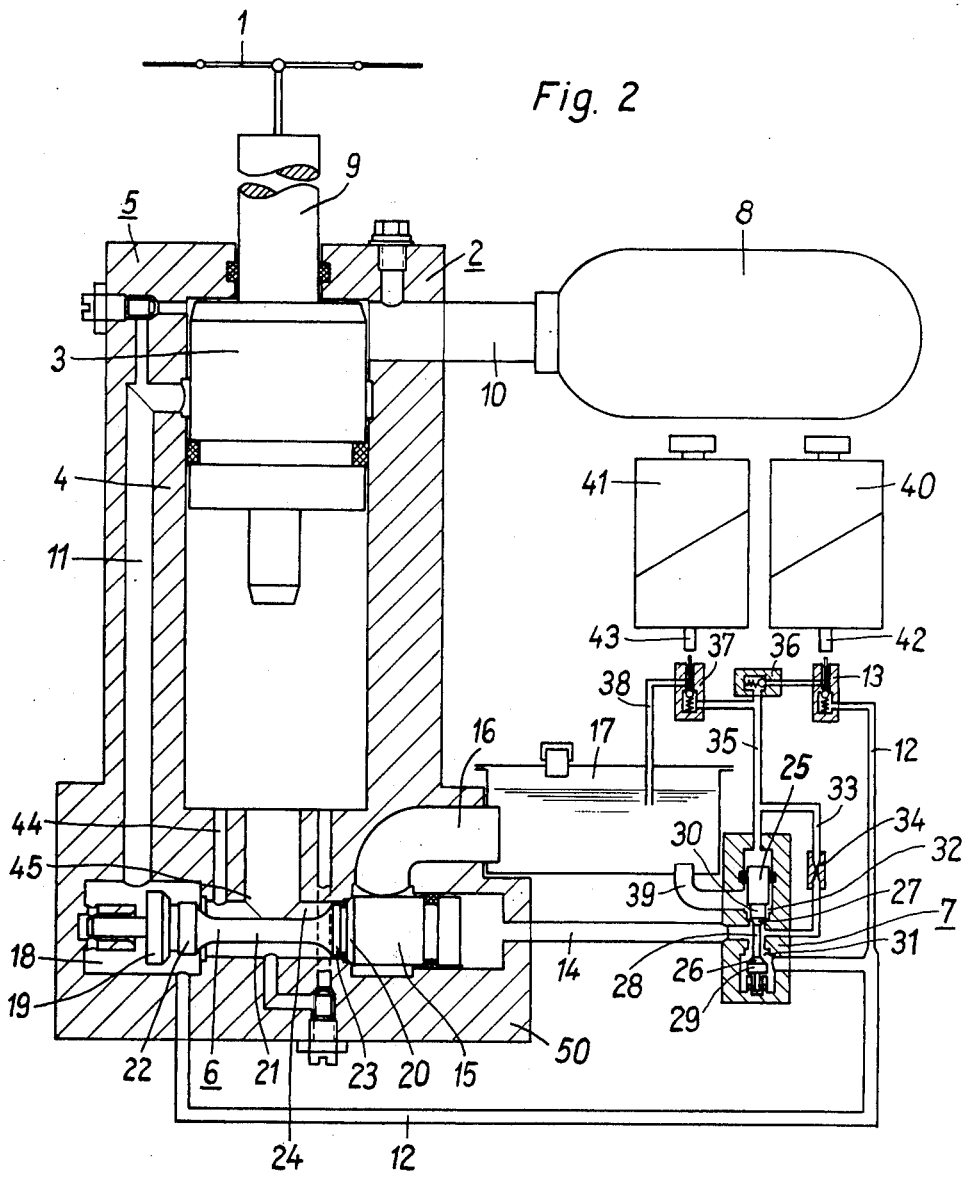
FIG. 2 is also a schematic diagram and shows the embodiment according to FIG. 1 wherein the differential pistons are disposed corresponding to the condition of the circuit breaker in the closed position.

In order to transfer the circuit breaker from the closed position shown in FIG. 2 into the open position, a signal is applied to the electromagnetic positioning member 41 which actuates the armature 43 thereof in the direction for opening the spring-loaded control valve 37. This action causes the line 35 carrying pressure fluid to be opened and connected with the low-pressure chamber 17. The throttling point 34 in the bypass 33 is configured so that a pressure drop results in the line 35 when the control valve 37 is opened, which together with the pressure present at the differential piston 25 from the line 12, leads to a reversal of the differential piston 25, until the latter is transferred into its other position, which corresponds to the position shown therefor in FIG. 1. In this way, the inlet valve 26 of the control valve arrangement 7 is closed and the line 14 is connected through the line 39 with the low-pressure chamber 17 through the open outlet valve 27. The valve 27 can be viewed as opening a valve outlet passage of the main-valve arrangement.

The pressure drop produced in the line 14, together with the pressure acting on the differential piston 15 from the high-pressure side, reverses the differential piston 15. The piston 15, in the position shown in FIG. 1, closes the inlet valve 19 and opens the outlet valve 20. The valve 20 thus opens a valve outlet passage of the actuator 5. The differential piston 3 of the actuator 5 is therefore moved downward under the pressure of the pressure fluid acting in the line 10. The volume of pressure fluid displaced thereby escapes through the valve outlet passage opened by valve 20 and through the line 16 into the low-pressure chamber 17.

The ancillary bodies 22, 23 are bridged by the valve rod 21 and the function of these bodies 22, 23 in the main-valve arrangement 6 follows from the spacing of the free end-faces relative to the length of the cylinder cavity which is common to both ancillary bodies 22, 23. The ratio of the distance of the two ancillary bodies 22, 23 from each other to the length of the cylinder bore is made so that the ancillary body 22 leaves the bore only when the ancillary body 23 is already in the bore, and vice versa. This assures that during the reversal of the differential piston 15, a direct connection between the high-pressure side and the low-pressure side is prevented and increased consumption of pressure fluid is avoided.

The ancillary bodies 29, 30 in the control valve arrangement 7 serve essentially the same purpose.

Assuming that a release command for the circuit breaker is shorter than the time it takes the control differential piston 25 to travel from one of its preferred positions through the unstable position, the differential piston 25 automatically drops back to the preferred position it just left without setting the differential piston 15 of the main valve arrangement in motion. This means that the differential piston 3 of the actuator 5 remains in its position, uninfluenced by a release command of such short duration. Only if the command has a duration which drives the control differential piston 25 of the control valve arrangement 7 clearly beyond its unstable position, does a reversal of the main-valve arrangement 6 and therefore, of the actuator 5 occur.

As long as the control differential piston 25 has passed through its unstable position, it is unimportant for the switching motion of the drive piston 3 whether or not the release command still persists, because the differential piston reaches and retains its preferred position automatically, independently of the continued existence of a reversal command.

The hydraulic actuating device according to the invention is furthermore configured advantageously so that in the event of a pressure drop in the line carrying the pressure fluid below a predetermined minimum value down to zero, the instantaneous position of the pistons is retained through a defined friction. This defined friction can be produced, for instance, by the seals of the pistons 15 and 25 which are necessary in any event.

Through the application of the fluid actuating device according to the invention, a number of advantages are obtained. These advantages include the nonoccurence of creeping switching movements. Furthermore, operationally reliable switching is possible, because the closing and opening commands are transmitted unequivocally to the movable contacts of the power circuit breaker. The fluid actuating device is capable of transmitting the closing and opening commands to the movable contacts of the circuit breaker without delay.

What is claimed is:

1. A fluid actuating device for an electric switching apparatus such as a high-voltage power circuit breaker or the like comprising an actuator for actuating the electric switching apparatus, said actuator including a cylinder and an actuator differential piston movable in said cylinder between first and second positions corresponding to the open and closed positions of the switching apparatus, said actuator differential piston having two end-faces for receiving fluid pressure force; high-pressure fluid supply means for supplying fluid under high-pressure to said end-faces; a main-valve arrangement including a main-valve differential piston movable between two end positions for alternately interrupting and connecting the fluid from said fluid supply means to one of said end-faces of said actuator differential piston whereby said actuator differential piston is caused to move between said first and second positions, said main-valve differential piston having two end-faces fluidly connected to said fluid supply means; and, a control valve arrangement including a control differential piston movable between two end positions for interrupting and connecting the fluid supply from said fluid supply means to one of said end-faces of said main-valve differential piston, said control differential piston having two end-faces also fluidly connected to said fluid supply means, and control means for actuating said control differential piston in response to inputs for opening and closing the switching apparatus by alternately interrupting and connecting the fluid from said fluid supply means to one of said end-faces of said control differential piston; said other one of said end-faces of each of said differential pistons being connected directly to said high-pressure fluid supply means to cause the same to be subjected continuously to the pressure of said fluid, said other one of said end-faces of each of said differential pistons being smaller than said one end-face thereof; said actuator differential piston, said main-valve differential piston and said control differential piston being actuable exclusively by the pressure of the fluid of said fluid supply means whereby said two end positions of each of said differential pistons are maintained independent of the instantaneous value of the pressure of the fluid.

2. The fluid actuating device of claim 1, said actuator further including a valve inlet passage for directing fluid from said fluid supply means to said one end-face of said actuator differential piston to move said actuator differential piston to one of said two positions thereof, and a valve outlet passage for directing fluid away from said one end-face of said actuator differential piston to a low pressure location; and said main-valve arrangement further comprising two valves corresponding to respective ones of said passages for opening and closing the same in dependence upon the position of said main-valve differential piston, said main-valve differential piston comprising a valve rod, said valves being mounted on respective ends of said valve rod whereby one of said passages is opened and the other one of said passages is closed when said main-valve differential piston is in one of said end positions thereof and vice versa when the same is in the other one of said end positions thereof.

3. The fluid actuating device of claim 2, said main-valve differential piston being provided with mutually adjacent ancillary valve bodies mounted on respective ends of said valve rod thereof next to corresponding ones of said valves thereon, said main-valve arrangement comprising a housing, said valve inlet passage and said valve outlet passage being formed in said housing, said housing defining valve seats for corresponding ones of said valves and a cylindrical bore located between said valve seats for accommodating the movement of said ancillary valve bodies therein, said cylindrical bore communicating with said one end-face of said actuator at a location of said bore between said valve seats whereby the portion of said bore on one side of said last-mentioned location constitutes at least a portion of said valve inlet passage and the portion of said bore on the other side constitutes at least a portion of said valve outlet passage, said ancillary valve bodies being spaced from each other a distance selected to ensure that one of said ancillary valve bodies will remain in said bore until at least a portion of said other ancillary valve body has entered said bore during the movement of said main-valve differential piston from one of said two end positions to the other one of said two end positions whereby a direct connection between said fluid supply means and said low pressure location is prevented.

4. The fluid actuating device of claim 3, said valve seat corresponding to said valve inlet passage of said actuator having a diameter smaller than the diameter of said main-valve differential piston.

5. The fluid actuating device of claim 2, said main-valve arrangement further including a valve inlet passage for directing fluid from said fluid supply means to said one end-face of said main-valve differential piston to move said main-valve differential piston to one of said two end positions thereof, and a valve outlet passage for directing fluid away from said one end-face of said main-valve differential piston to said low pressure location; and said control valve arrangement comprising two valves corresponding to respective ones of said passages of said main-valve arrangement for opening and closing the same in dependence upon the position of said control differential piston, said control differential piston comprising a valve rod, said last-mentioned valves being mounted on respective ends of said last-mentioned valve rod whereby one of said passages of said main-valve arrangement is opened and the other one of said passages of said main-valve arrangement is closed when said control differential piston is in one of said end positions thereof and vice versa when the same is in the other one of said end positions thereof.

6. The fluid actuating device of claim 5, said control differential piston being provided with respective mutually adjacent ancillary valve bodies mounted on respective ends of said valve rod thereof next to corresponding ones of said valves thereon, and said control valve arrangement comprising a control valve housing having respective bores for accommodating corresponding ones of said last-mentioned ancillary valve bodies, said control valve housing defining valve seats for corresponding ones of said valves of said control valve arrangement, said last-mentioned valve seats defining valve openings in said control valve housing, said bores of said control valve housing communicating with said one end-face of said main-valve differential piston, said bores further communicating with said last-mentioned valve openings respectively, said last-mentioned ancillary valve bodies being spaced from each other a distance selected to ensure that one of said ancillary valve bodies will remain in its bore until at least a portion of said other ancillary valve body has entered its bore during the movement of said control valve differential piston from one of its two end positions to the other one of its two end positions whereby a direct connection between said fluid supply means and said low pressure location is prevented.

7. The fluid actuating device of claim 6 wherein one of said last-mentioned ancillary valve bodies is disposed in its bore when the control valve differential piston is in one of its said two end positions, said last-mentioned ancillary valve bodies being arranged with respect to their bores and being spaced from each other to insure that the ancillary valve body disposed in its bore will move through a predetermined distance therein before the passage corresponding to said last-mentioned bore is opened whereby a reversal of said main-valve differential piston can occur only after a delay and whereby said control valve differential piston occupies an unstable position between said two end positions thereof from which said control valve differential piston can fall back to its initial end position in the event that the input to said control means is of a duration too short to effect a reversal of the control valve differential piston.

8. The fluid actuating device of claim 6, the valve seat corresponding to said valve corresponding to said valve inlet passage of said main-valve arrangement having a diameter smaller than the diameter of said control differential piston.

9. The fluid actuating device of claim 8, said main-valve differential piston having a cylindrical configuration and being provided with respective mutually adjacent ancillary valve bodies mounted on respective ends of said valve rod thereof next to corresponding ones of said valves thereon, said main-valve arrangement comprising a housing having a cylindrical opening formed therein so as to be common to both of said ancillary valve bodies.

10. The fluid actuating device of claim 9, said valve corresponding to said valve inlet passage of said actuator having a valve seat, the diameter of said valve seat being smaller than the diameter of said main-valve differential piston.

11. The fluid actuating device of claim 5, said control valve arrangement further including a bypass connected in parallel with said control differential piston for maintaining fluid pressure on said control differential piston when the same is in the end position thereof whereat said inlet passage of said main-valve arrangement is opened thereby selfholding said control differential piston in said last-mentioned end position.

12. The fluid actuating device of claim 11, said control means comprising at least two spring-loaded control valves, one of said control valves being provided for interrupting the flow of fluid to said one end-face of said control differential piston from said fluid supply means in response to one of the inputs to said control means, the other one of said control valves communicating with said one end-face of said control differential piston for directing fluid away therefrom in response to the other one of the inputs to said control means.

13. The fluid actuating device of claim 12, one of the ends of said bypass communicating with said one end-face of control differential piston and the other end of said bypass communicating with said passages of said main-valve arrangement, throttle means connected serially into said bypass for causing a drop in the pressure of the fluid at said one end-face of said control differential piston when said other one of said control valves is opened.

14. The fluid actuating device of claim 1, said control means comprising at least two spring-loaded control valves, one of said control valves being provided for interrupting the flow of fluid in said one end-face of said control differential piston from said fluid supply means in response to one of the inputs to said control means, the other one of said control valves communicating with said one end-face of said control differential piston for directing fluid away therefrom in response to the other one of the inputs to said control means.

15. The fluid actuating device of claim 14, said control means comprising actuation means responsive to said inputs for actuating said control valves.

16. The fluid actuating device of claim 15, said actuating means being respective electromagnetic positioning members corresponding to respective ones of said control valves.

17. The fluid actuating device of claim 14, said control means comprising a supply conduit connecting said one end-face of said control differential piston to said fluid supply means, said one control valve being connected into said supply conduit for interrupting the flow of fluid through said conduit to said one end-face of said control differential piston whereby said control differential piston moves from one of its end positions to the other one of its end positions, said other one of said control valves being connected to said supply conduit for directing fluid away from said one end-face of said control differential piston whereby said control differential piston returns to said one end position thereof.

18. The fluid actuating device of claim 17, said control means further comprising a check valve connected into said supply conduit in flow direction beyond said one control valve.

* * * * *